US007172353B2

(12) United States Patent
Sawai

(10) Patent No.: US 7,172,353 B2
(45) Date of Patent: Feb. 6, 2007

(54) IMAGE FORMING APPARATUS

(75) Inventor: Kunio Sawai, Daito (JP)

(73) Assignee: Funai Electric Co., Ltd., Osaka (JP)

( * ) Notice: Subject to any disclaimer, the term of this patent is extended or adjusted under 35 U.S.C. 154(b) by 0 days.

(21) Appl. No.: 11/242,852

(22) Filed: Oct. 5, 2005

(65) Prior Publication Data

US 2006/0083571 A1 Apr. 20, 2006

(30) Foreign Application Priority Data

Oct. 14, 2004 (JP) ..... 2004-300627

(51) Int. Cl.
*B41J 13/076* (2006.01)

(52) U.S. Cl. ..... 400/637; 400/639; 400/120.17; 400/663; 400/636.3; 347/198

(58) Field of Classification Search ..... 400/55, 400/59, 36, 120.01, 120.16, 120.17, 124.11, 400/124.12, 124.13, 192, 194, 196, 207, 400/208, 225, 229, 236.2, 465, 636, 636.3, 400/637, 637.2, 641; 347/220, 192, 109, 347/198

See application file for complete search history.

(56) References Cited

U.S. PATENT DOCUMENTS 5,221,932 A * 6/1993 Kurita ..... 347/220
5,957,599 A * 9/1999 Yamada ..... 400/636
7,014,376 B2 * 3/2006 Maruyama et al. .... 400/120.01
2005/0057634 A1 * 3/2005 Huegle ..... 347/109
2005/0069370 A1 * 3/2005 Yamada et al. ..... 400/663

FOREIGN PATENT DOCUMENTS

| | | |
|---|---|---|
| JP | 64-1962 U | 1/1989 |
| JP | 10-202927 A | 8/1998 |
| JP | 2000-168188 A | 6/2000 |

* cited by examiner

*Primary Examiner*—Terrell L. McKinnon
*Assistant Examiner*—Joshua M. Dubnow
(74) *Attorney, Agent, or Firm*—Global IP Counselors, LLP

(57) ABSTRACT

An image forming apparatus has a chassis; a print head unit pivotably supported by the chassis; a platen roller rotatably supported by the chassis to perform printing with the print head unit; a metal feed roller rotatably supported by the chassis to convey paper; a metal press roller rotatably supported to the chassis so as to be pressed against the feed roller to convey paper; and feed roller bearings mounted to the chassis for rotatably supporting the feed roller. The feed roller bearings have contact parts that project toward the print head unit, such that the contact parts are pressed into contact with the print head unit when the print head unit is pressed against the platen roller during printing. The precision with which paper is fed and printing is performed can be improved.

9 Claims, 8 Drawing Sheets

PRIOR ART

IMAGE FORMING APPARATUS

BACKGROUND OF THE INVENTION

1. Field of the Invention

The present invention relates to an image forming apparatus. More specifically, the present invention relates to an image forming apparatus having a feed roller bearing and a print head.

2. Background Information

In conventional practice, various structures for ensuring precision in positioning the print head in relation to a platen roller have been proposed in fax machines and other such image forming apparatuses.

Also, heat transfer printers are known in conventional practice as examples of image forming apparatuses. As shown in the schematic view of FIG. 15*a*, such heat transfer printer generally includes a chassis 101, a printer head unit 104 pivotably supported by the chassis 101, a platen roller rotatably supported by the chassis 101 opposite the printer head unit 104, a pressing mechanism 107 pivotably supported to the chassis 101, a feed roller 109 rotatably supported by the chassis 101 via bearings, a press roller 110 supported by the chassis 101 opposite the feed roller 109, and a drive gear 108 having a small gear 108*a* and a large gear 108*b* for pivoting the pressing mechanism 107.

The print head unit 104 has a support axle 104*a*, an arm unit 104*b*, and a print head 104*c*, as shown in FIG. 15. The print head unit 104 is also mounted on the inner sides of the chassis 101 at the support axle 104*a* so as to be capable of pivoting, as shown in FIG. 15. Also, as shown in FIG. 15, a helical torsion spring 114 is mounted between the support axle 104*a* of the print head unit 104 and the chassis 101. This helical torsion spring 114 urges the print head unit 104 in a direction away from the platen roller 105. Also, a bent part 104*d* that is pressed by the pressing mechanism 107 is formed in the arm unit 104*b* of the print head unit 104 so as to be bent toward the chassis 101. As shown in FIG. 15, the print head 104*c* is pressed against the platen roller 105 via the paper 130 and an ink sheet during the printing operation.

Also, the pressing mechanism 107 has two pivoting members 107*a* each having a toothed section 107*d*, and a support rod 107*c* that pivotably supports the pivoting members 107*a*. Press springs 107*e* for exerting pressure on the bent part 104*d* of the press roller 110 are provided to both of the pivoting members 107*a*. Also, the pivoting members 107*a* are tightly mounted on the support rod 107*c* so as to not to be relatively rotatable. The toothed section 107*d* of one of the pivoting members 107*a* meshes with the small gear 108*a* of the drive gear 108, as shown in FIG. 15. In this manner, the drive gear 108 transmits the drive force from a motor to the toothed section 107*d* of the pivoting member 107*a*.

Both ends of the feed roller 109 are supported by the chassis 101 via bearings. Protrusions of a specific height are partially formed by rolling on the surfaces of the feed roller 109.

During the printing operation, the print head 104*c* of the print head unit 104 is pressed on against the platen roller 105 via the paper 130. As shown in FIG. 15, the bent part 104*d* of the print head unit 104 is pressed on by the press spring 107*e* of the pivoting member 107*a* of the pressing mechanism 107 with an amount of pressure W3. As a result, the print head unit 104 receives an amount of frictional force μW3 in the paper conveying direction (direction of arrow C2 in FIG. 15). The symbol "μ" is the dynamic coefficient of friction. Also, the feed roller 109 receives a reaction force W4 in the opposite direction from the paper conveying direction, as a result of the conveying load of the paper 130 as the feed roller 109 conveys paper 130 during the printing operation.

The conventional heat transfer printer shown in FIG. 15 has drawbacks in that, since the print head unit 104 receives the frictional force μW3 in the paper conveying direction, the unit therefore tends to move in the paper conveying direction (direction of arrow C2 in FIG. 15). As a result, the position of the print head 104*c* of the print head unit 104 tends to become misaligned in relation to the platen roller 105. Thus, printing precision tends to be compromised. Also, the feed roller 109 tends to be moved in the direction opposite the paper conveying direction together with its bearings due to the reaction force W4 received in the direction opposite the paper conveying direction. Accordingly, precision in feeding of the paper 130 tends to be compromised.

In view of the above, it will be apparent to those skilled in the art from this disclosure that there exists a need for an improved image forming apparatus that overcomes the problems of the conventional art. This invention addresses this need in the art as well as other needs, which will become apparent to those skilled in the art from this disclosure.

SUMMARY OF THE INVENTION

An object of the present invention is to provide an image forming apparatus that allows paper feeding and printing with precision.

The image forming apparatus in accordance with the first aspect of the present invention is an image forming apparatus having a chassis; a print head unit pivotably supported by the chassis; a platen roller rotatably supported by the chassis to perform printing with the print head unit; a metal feed roller rotatably supported by the chassis to convey paper; a metal press roller rotatably mounted to the chassis so as to be pressed against the feed roller to convey paper; feed roller bearings mounted to the chassis for rotatably supporting the feed roller; and a contact portion formed integrally with at least one of the print head unit and the feed roller bearings, the contact portion bulging toward the other of the print head unit and the feed roller bearings, the print head unit and the feed roller bearings being arranged such that the contact portion is pressed into contact with the other of the print head unit and the feed roller bearings when the print head unit is pressed against the platen roller during printing.

With this image forming apparatus, the feed roller bearings and the print head unit come into contact with each other during printing such that the print head unit is pressed against the platen roller. Thus, when the paper is conveyed during printing, at least part of the frictional force received by the print head unit in the paper conveying direction is canceled out by the reaction force in the direction opposite the paper conveying direction received by the feed roller, which is rotatably supported on the feed roller bearings. Therefore, it is possible to restrict movement of the print head unit in the paper conveying direction due to the frictional force that is received by the print head unit in the paper conveying direction during printing. It is thereby possible to improve printing precision because fluctuation in the position of the print head unit in relation to the platen roller can be restricted during printing.

Also, since the reaction force received by the feed roller and the feed roller bearings in the direction opposite the paper conveying direction is canceled out by the frictional force of the print head unit, it is possible to stabilize the position of the feed roller bearings and the metal feed roller that conveys paper. As a result, the occurrence of paper feeding non-uniformities can be suppressed, and the precision of feeding paper can therefore be improved. Also, paper is conveyed by a metal feed roller and by a metal press roller, whereby the precision of feeding paper can be improved in comparison with a case in which paper is conveyed by a platen roller made of rubber or another such material prone to elastic deformation.

In the image forming apparatus according to the second aspect of the present invention, each of the feed roller bearings is unitarily provided with the contact portion. As a result of this configuration, the reaction force received by the feed roller in the direction opposite the paper conveying direction can be transmitted to the print head unit via the contact portion of the feed roller bearings. It is thereby possible to easily cancel out at least part of the frictional force received by the print head unit in the paper conveying direction during printing due to the reaction force transmitted to the print head unit.

Furthermore, the contact portion is formed unitarily with the feed roller bearings, whereby there is no need to separately provide parts for contacting with the print head unit. Therefore, the number of components can be prevented from increasing even if the contact portion is provided.

In the image forming apparatus in accordance with the third aspect of the present invention, a tapered portion is further formed on the contact portion. With this configuration, even if the print head comes into contact with the tapered portion of the contact portion of the feed roller bearings as the print head unit pivots in the direction toward the platen roller, the print head unit can be easily pressed against the platen roller because of the tapered portion of the contact portion.

In the image forming apparatus in accordance with the fourth aspect of the present invention, the print head unit has a print head, arm units pivotably supported by the chassis, a heat sink formed to cover the print head for radiating the heat of the print head, and the heat sink of the print head unit is unitarily provided with the contact portion. As a result of this configuration, the frictional force received by the print head unit in the paper conveying direction can be transmitted to the feed roller and the feed roller bearings via the contact portion provided to the head sink of the print head unit. At least part of the frictional force received by the print head unit in the paper conveying direction during printing can thereby be easily canceled out by the reaction force received by the feed roller. Also, by unitarily providing the heat sink with the contact portion that comes into contact with the feed roller bearings, there is no need to separately provide a protrusion that comes into contact with the feed roller bearings. Therefore, the number of components can be prevented from increasing even while providing such contact portion.

In the image forming apparatus in accordance with the fifth aspect of the present invention, the print head unit is supported by the chassis with support axes, and the support axes support the print head unit such that the print head unit is horizontally movable when the print head unit is pressed against the platen roller. With this configuration, the print head unit can be moved horizontally by the frictional force received by the print head unit in the paper conveying direction during printing. Thus, when the print head unit is pivoted toward the platen roller in a state in which there is no contact between the print head unit and the feed roller bearings, the print head unit can be moved horizontally toward the feed roller bearings. In this manner, the print head unit and the feed roller bearings can easily be brought into contact.

In the image forming apparatus in accordance with the sixth aspect of the present invention, the support axes are inserted in support holes formed on the print head unit, and an inside diameter of the support holes is larger than an outside diameter of the support axes.

In the image forming apparatus in accordance with the seventh aspect of the present invention, the contact portion is bulging portions that are formed unitarily with each feed roller bearing so as to bulge toward the print head unit.

In the image forming apparatus in accordance with the eighth aspect of the present invention, the contact portion is a plurality of L-shaped protrusions that extend toward the feed roller bearings.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

Embodiments of the present invention will now be described with reference to Figures.

First Embodiment

Figure 1:
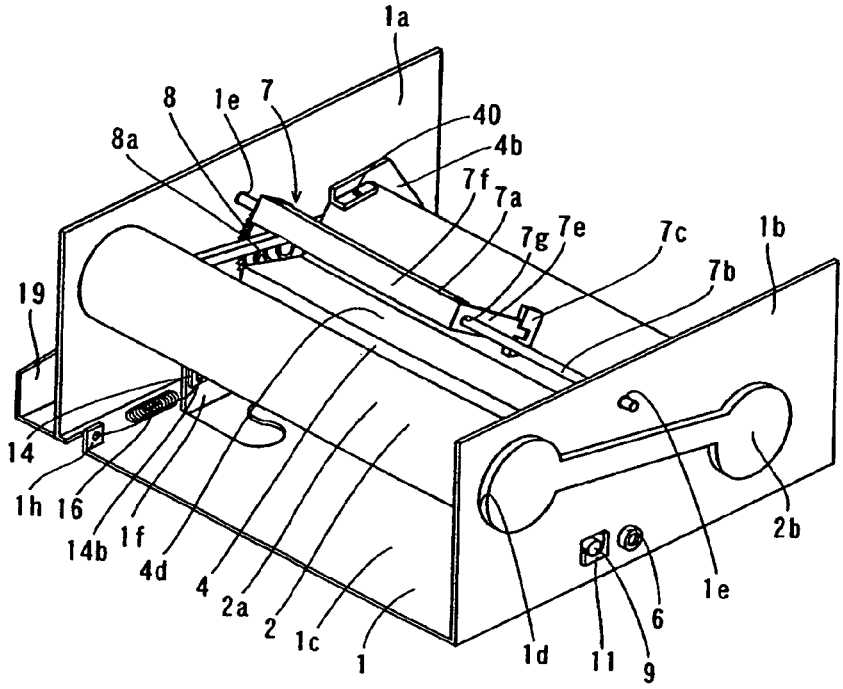
FIG. 1 is a perspective view of the entire structure of a heat transfer printer according to the first embodiment of the present invention.

FIG. 1 is a perspective view of the entire structure of a heat transfer printer according to the first embodiment of the present invention. FIGS. 2 through 11 are diagrams for describing the detailed structure of the heat transfer printer according to the first embodiment of the present invention shown in FIG. 1. The structure of the heat transfer printer according to the first embodiment of the present invention will now be described with reference to FIGS. 1 through 11. In the present embodiment, a heat transfer printer is described as an example of an image forming apparatus.

Figure 2:
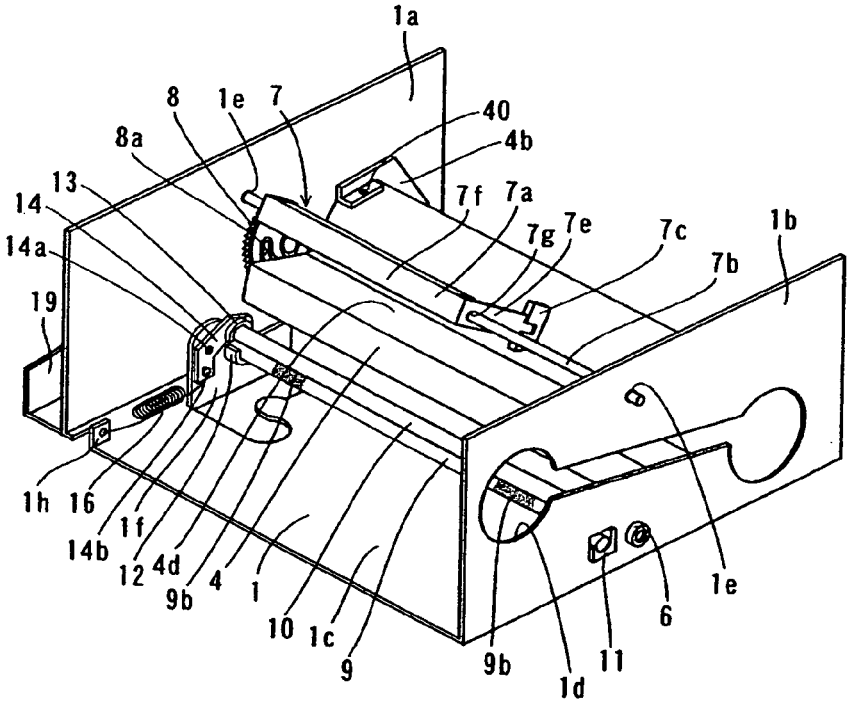
FIG. 2 is a perspective view of the heat transfer printer according to the first embodiment shown in FIG. 1 without the ink ribbon cartridge.
Figure 3:
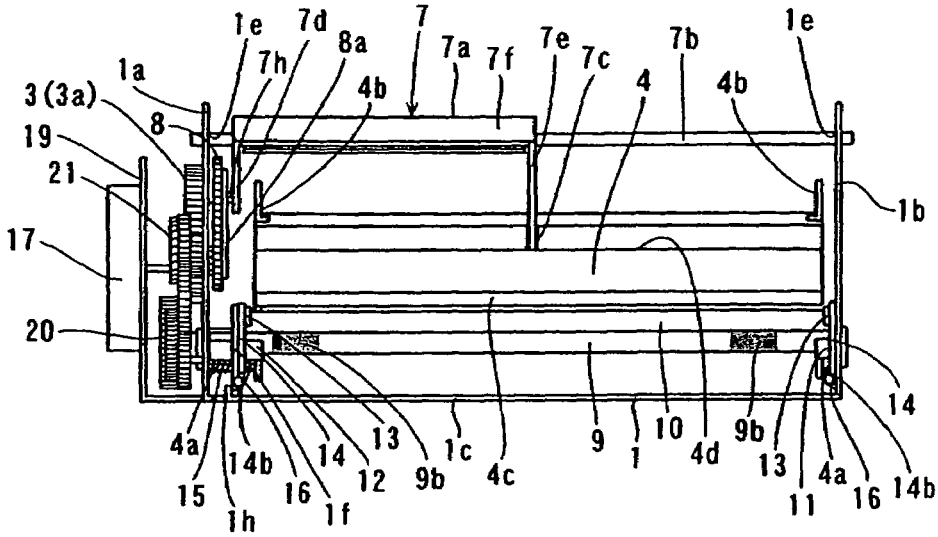
FIG. 3 is a front view of the heat transfer printer according to the first embodiment shown in FIG. 1 without the ink ribbon cartridge.
Figure 4:
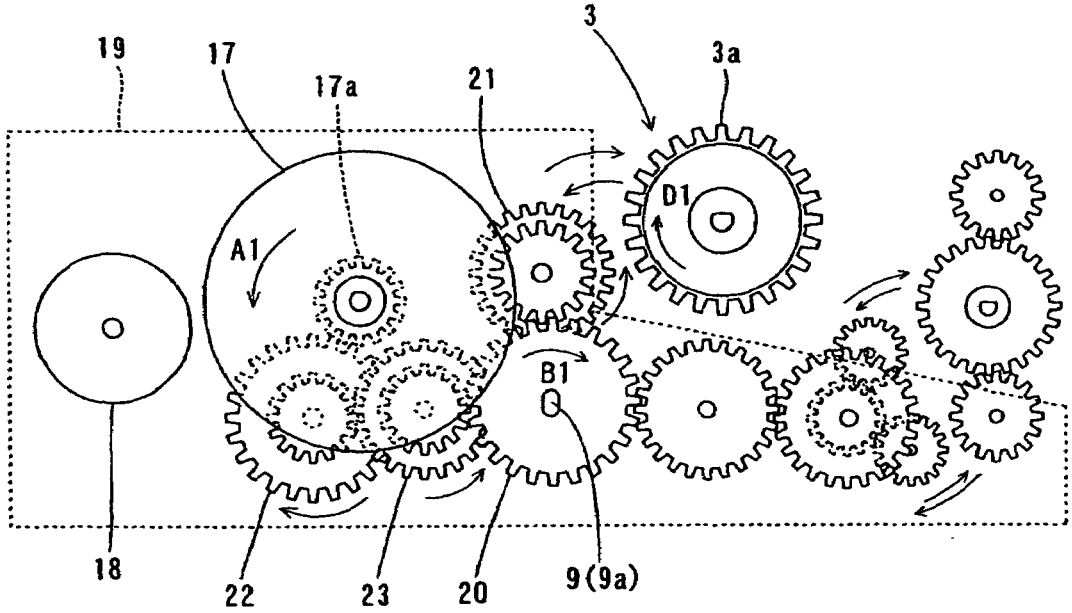
FIG. 4 is a schematic side view of the motor and gears of the heat transfer printer according to the first embodiment shown in FIG. 1.

As shown in FIGS. 1 through 4 and 10, the heat transfer printer according to the first embodiment of the present invention includes a metal chassis 1, an ink ribbon cartridge 2, a winding reel 3 (see FIG. 4), a print head unit 4 pivotably supported by the chassis 1 for printing, a platen roller 5 (see FIG. 10) rotatably supported by the chassis 1 opposite the print head unit 4, platen roller bearings 6 for rotatably supporting the platen roller 5, a pressing mechanism 7, a resinous cam gear 8, a metal feed roller 9 (see FIG. 2) for conveying paper 30, a metal press roller 10 (see FIG. 2) that is pressed against the feed roller 9 with a specific amount of pressure, feed roller bearings 11 and 12 for rotatably supporting the feed roller 9, press roller bearings 13 (see FIG. 2) for rotatably supporting the press roller 10, bearing support plates 14, a torsion coil spring 15 (see FIGS. 3 and 10), an extension coil spring 16, a motor 17 (see FIG. 3) for driving the feed roller 9 and the winding reel 3 and the like, a motor 18 for driving the pressing mechanism 7, a motor bracket 19, a feed roller gear 20 (FIG. 4), a swing gear 21 (see FIG. 4), and intermediate gears 22 and 23 (see FIG. 4). The motors 17 and 18 of the present invention are not limited to any particular type of motors. Any known type of motor may be used as the motor 17 and/or motor 18 as long as such motor can satisfy the purpose of the present invention.

Figure 6:
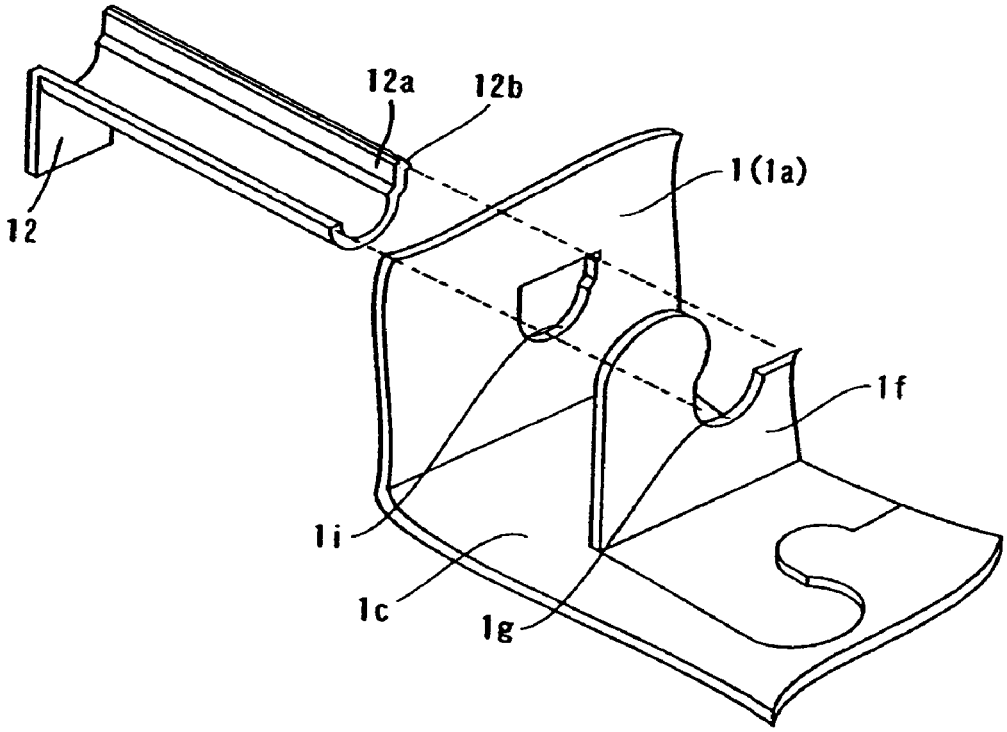
FIG. 6 is a partial schematic exploded for describing the structure for mounting the feed roller bearing to the chassis in the heat transfer printer according to the first embodiment shown in FIG. 1.

Also, as shown in FIGS. 1 and 2, the chassis 1 has a first side surface 1*a*, a second side surface 1*b*, and a bottom surface 1*c*. The motor bracket 19 is mounted on the first side surface 1*a* of the chassis 1. Also, the second side surface 1*b* that faces the first side surface 1*a* of the chassis 1 is provided with a cartridge insertion hole 1*d* through which the ink ribbon cartridge 2 is inserted. The first side surface 1*a* and the second side surface 1*b* of the chassis 1 are both provided with insertion holes 1*e* for rotatably supporting the pressing mechanism 7. The bottom surface 1*c* of the chassis 1 is provided with a bent piece 1*f* that is formed by cutting out a part of the bottom surface 1*c* and bending the part upright. This bent piece 1*f* is provided with a feed roller bearing supporting part 1*g* for supporting the feed roller bearing 11, as shown in FIG. 6. Also, as shown in FIGS. 1 and 2, the bottom surface 1*c* of the chassis 1 is provided with a spring mounting part 1*h* in which one end of the extension coil spring 16 is mounted.

The ink ribbon cartridge 2 has a winding part 2*a* and a supply part 2*b*, as shown in FIG. 1. A winding bobbin (not shown) and a supply bobbin 2*c* (see FIG. 10) are disposed in the interiors of the winding part 2*a* and the supply part 2*b* of the ink ribbon cartridge 2, respectively. An ink ribbon 2*d* is wound around the winding bobbin and the supply bobbin 2*c*. The winding reel 3 functions to take up the ink ribbon 2*d* that is wound around the winding bobbin and the supply bobbin 2*c* by engaging with the winding bobbin. Also, as shown in FIG. 4, a gear 3*a* of the winding reel 3 is disposed so as to be brought to engagement with the swing gear 21 due to the swinging of the swing gear 21. In this manner, the gear 3*a* of the winding reel 3 can receive torque from the feed roller gear 20.

Figure 9:
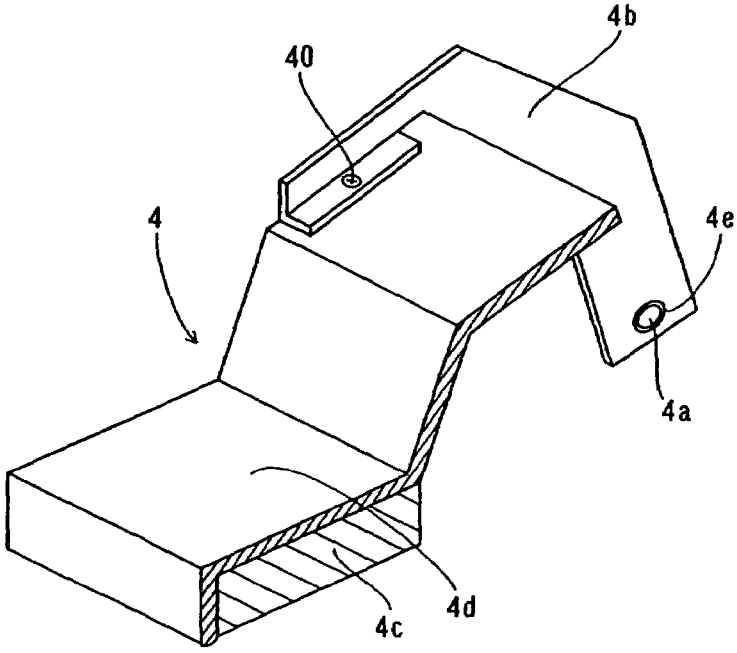
FIG. 9 is a partial cross-sectional view of the print head unit in the heat transfer printer according to the first embodiment shown in FIG. 1.
Figure 10:
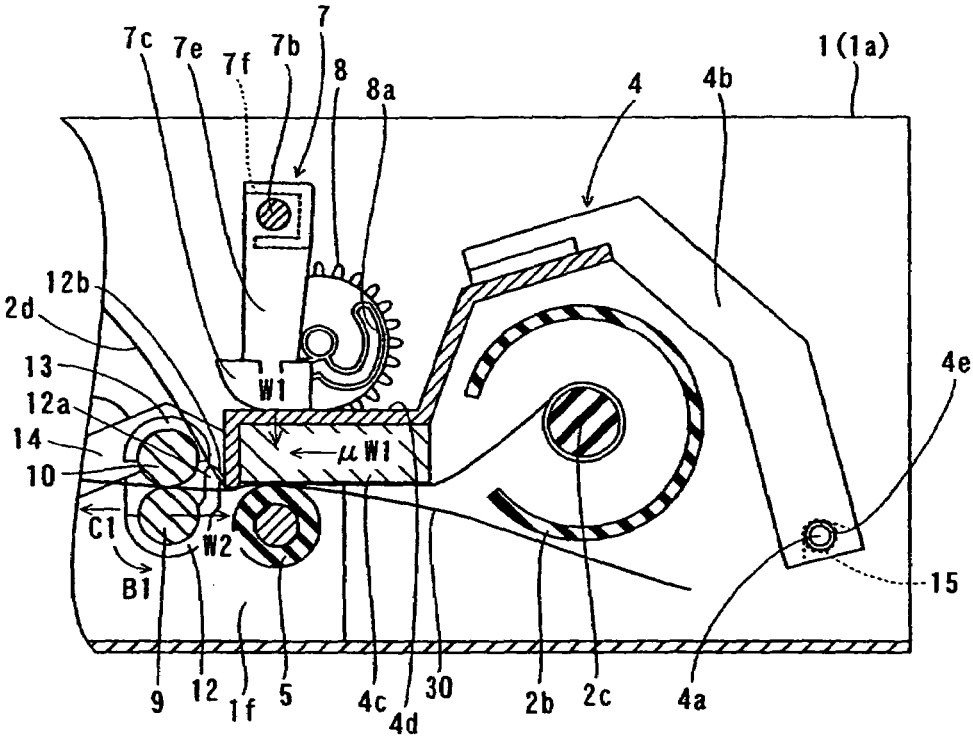
FIG. 10 is a schematic side view of the pressing mechanism in a state in which the print head unit is pressed against the platen roller in the heat transfer printer according to the first embodiment shown in FIG. 1.
Figure 11:
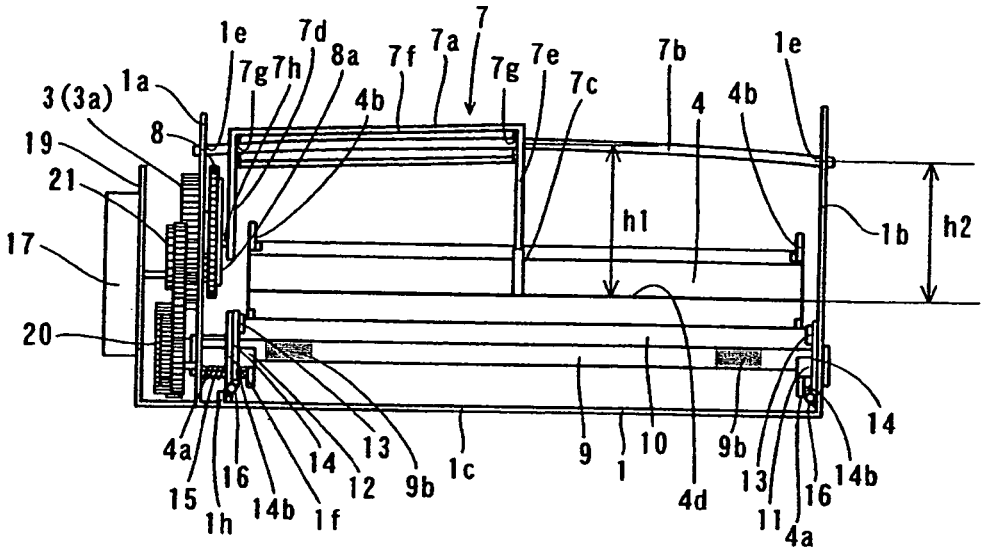
FIG. 11 is a front view of the pressing mechanism in a state in which the print head unit is pressed against the platen roller in the heat transfer printer according to the first embodiment shown in FIG. 1.

The print head unit 4 is supported by the chassis 1 so as to be pivotable around support axes 4*a*, and includes arm units 4*b*, a print head 4*c*, a heat sink 4*d* formed to cover the print head for radiating the heat of the print head unit 4, and support holes 4*e*, as shown in FIGS. 9–11. The print head unit 4 is also mounted on the inner sides of the first side surface 1*a* and the second side surface 1*b* of the chassis 1 so as to be capable of pivoting around the support axis 4*a*, as shown in FIG. 3. Also, as shown in FIGS. 3 and 10, the torsion coil spring 15 is mounted on the support axis 4*a* of the print head unit 4 on the side of the first side surface 1*a* of the chassis 1. This torsion coil spring 15 functions to urge the print head unit 4 in a direction away from the platen roller 5. Also, as shown in FIG. 9, each of the arm units 4*b* of the print head unit 4 is mounted on the heat sink 4*d* with a screw 40. The print head 4*c* is capable of selectively and controllably heating any part of its printing surface, so as to perform heat transfer printing. The print head 4*c* of the present invention is not limited to any particular type of print head. Any known type of print head may be used as the print head 4*c* as long as such print head can satisfy the purpose of the present invention.

In the first embodiment, as shown in FIGS. 9 and 10, the support hole 4*e* has a larger inside diameter than the outside diameter of the support axis 4*a* so that the support axis 4*a* can support the print head unit 4 while allowing the print head unit to pivot and move horizontally within a predetermined amount when the print head unit 4 is pressed against the platen roller 5. Also, as shown in FIG. 10, the print head 4*c* of the print head unit 4 is disposed so that pressure is applied to the platen roller 5 via the paper 30 and the ink ribbon 2*d*.

Figure 8:
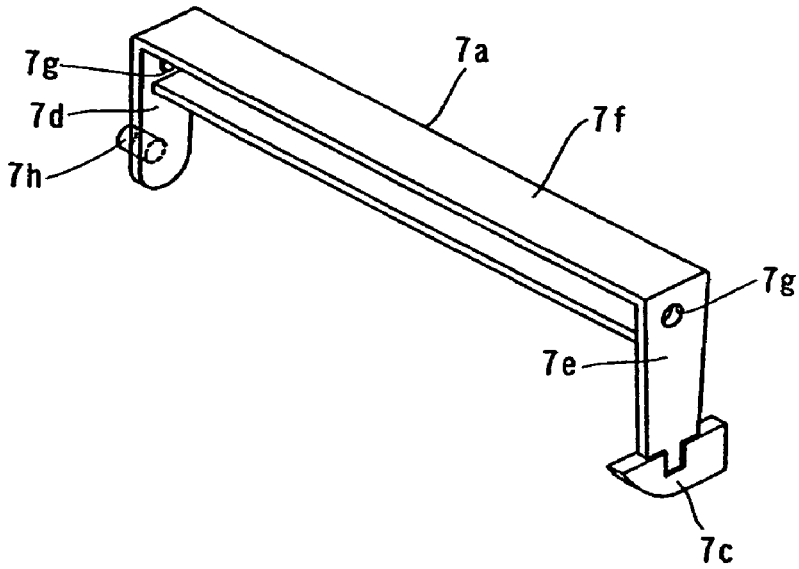
FIG. 8 is a perspective view of the pivotable member in the heat transfer printer according to the first embodiment shown in FIG. 1.

Also, as shown in FIGS. 1 through 3, the pressing mechanism 7 has a pivotable member 7*a*, an elastically deformable support rod 7*b* made of piano wire with a diameter of about 3 mm, and a resinous cap 7*c*. As shown in FIG. 8, the pivotable member 7*a* of the pressing mechanism 7 is formed into a U shape that includes a first side part 7*d*, a second side part 7*e*, and a linking part 7*f* for linking the first side part 7*d* and the second side part 7*e*. The first side part 7*d* and the second side part 7*e* of the pivotable member 7*a* are both provided with holes 7*g* for mounting the support rod 7*b*. The first side part 7*d* of the pivotable member 7*a* is also provided with a cam pin 7*h* which engages a cam groove 8*a* (see FIGS. 1 through 3) of the cam gear 8, through which the drive force from the motor 18 is transmitted. The resinous cap 7*c* is mounted at the end of the second side part 7*e* of the pivotable member 7*a*. The cap 7*c* is mounted so as to be in contact with the top surface of the heat sink 4*d* of the print head unit 4 at all times. Also, as shown in FIG. 11, the height h1 from the bottom of the cap 7*c* to the middle of the hole 7*g* of the second side part 7*e* of the pivotable member 7*a* is formed to be about 2.4 mm greater than the height h2 from the top of the heat sink 4*d* to the middle of the insertion holes 1*e* in the chassis 1 while the print head unit 4 is pivoted toward the platen roller 5. Thus, the support rod 7*b* bends upward by about 2.4 mm when the pressing mechanism 7 applies pressure to the print head unit 4.

As shown in FIGS. 2 through 4, the metal feed roller 9 is provided with a gear insertion unit 9*a* (see FIG. 4) and paper conveying portions 9*b*. The feed roller 9 is also rotatably supported by the feed roller bearings 11 and 12. The gear insertion unit 9*a* of the feed roller 9 is also engaged with the feed roller gear 20 relatively unrotatably, as shown in FIG. 4. Protrusions of a specific height are formed by rolling on the surface of the paper conveying portions 9*b* of the metal feed roller 9. It is thereby possible to accurately convey the paper 30 with the paper conveying portions 9*b* of the feed roller 9.

The metal press roller 10 is rotatably supported by the press roller bearings 13, as shown in FIGS. 2 and 3. The press roller bearings 13 are mounted on the bearing support plates 14. The bearing support plates 14 are mounted to the inner sides of both the second side surface 1*b* and the bent piece 1*f*, which is provided to the bottom surface 1*c* of the chassis 1 so as to be capable of pivoting around support units 14*a*, as shown in FIG. 2. Also, the other ends of the extension coil springs 16, which urge the press roller 10 in the direction toward the feed roller 9, are mounted on the spring mounting units 14*b* of the bearing support plates 14.

Figure 5:
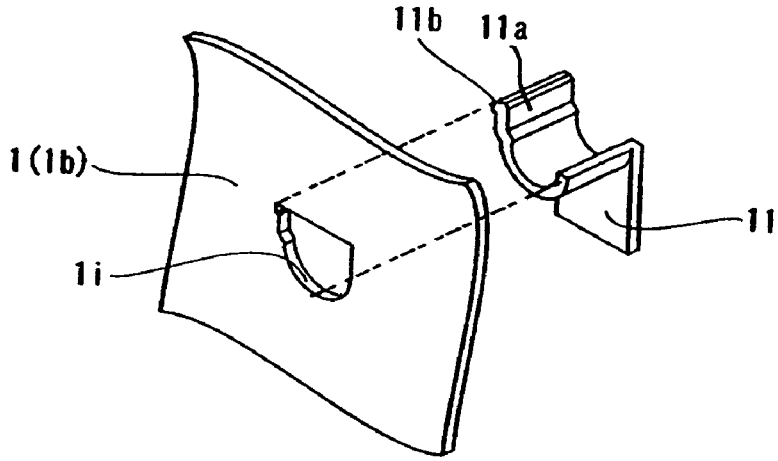
FIG. 5 is a partial schematic exploded view for describing the structure for mounting the feed roller bearing to the chassis in the heat transfer printer according to the first embodiment shown in FIG. 1.
Figure 7:
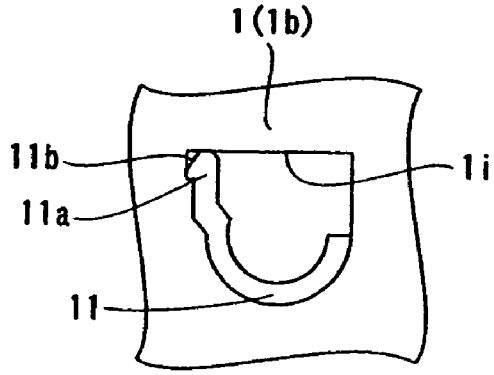
FIG. 7 is a partial side view of the feed roller bearing in the heat transfer printer according to the first embodiment shown in FIG. 1.

In the first embodiment, contact parts 11*a* and 12*a* that come into contact with the heat sink 4*d* of the print head unit 4 as shown in FIG. 10 are unitarily provided to the feed roller bearings 11 and 12, as shown in FIGS. 5 through 7. The contact parts 11*a* and 12*a* are bulging portions that bulge toward the print head unit 4; The feed roller bearing 11 mounted on the second side surface 1*b* of the chassis 1 is supported in a bearing support hole 1*i* formed in the second side surface 1*b* of the chassis 1, as shown in FIG. 5. The feed roller bearing 12 mounted on the first side surface 1*a* of the chassis 1 is supported in a bearing support hole 1*i* formed in the first side surface 1*a* and a bearing support part 1*g* of the bent piece 1*f* provided to the bottom surface 1*c* of the chassis 1, as shown in FIG. 6. The feed roller bearing 12 mounted on the first side surface 1*a* of the chassis 1 is longer in the axial direction than the feed roller bearing 11 mounted on the second side surface 1*b* of the chassis 1, so that the feed roller bearing 12 can be supported by the bearing support part 1*g* of the bent piece 1*f*. Also, tapered parts (chamfered parts) 11*b* and 12*b* formed in tapered shapes are provided to top portions of the contact parts 11*a* and 12*a* of the feed roller bearings 11 and 12.

The drive force of the motor 17 for driving the feed roller 9 which is mounted on the motor bracket 19 and the winding reel 3 is transmitted to the feed roller gear 20 and the gear 3*a* of the winding reel 3 via the intermediate gears 22 and 23, as shown in FIG. 4.

Next, the printing operation of the heat transfer printer according to the first embodiment of the present invention will be described with reference to FIGS. 3, 4, and 10. First, the drive force of the motor 18 is transmitted to the cam pin 7*h* (see FIGS. 3 and 8) of the pressing mechanism 7 that engages with the cam groove 8*a* (see FIGS. 3 and 10) of the cam gear 8 (see FIGS. 3 and 10) as the motor 18 (see FIG. 4) is driven. The support rod 7*b* thereby bends upward as the pivotable member 7*a* (see FIG. 3) of the pressing mechanism 7 pivots around the support rod 7*b*. Thus, the cap 7*c* mounted on the end of the second side part 7*e* of the pivotable member 7*a* of the pressing mechanism 7 is pressed against the top surface of the heat sink 4*d* of the print head unit 4 with a pressing force of W1, which is about 5 kgf in this embodiment.

Even if the front surface of the heat sink 4*d* of the print head unit 4 collides with the contact parts 11*a* and 12*a* while the print head unit 4 is being pivoted to the position shown in FIG. 10, it is the tapered parts (chamfered parts) 11*b* and 12*b* of the feed roller bearings 11 and 12 that contact the heat sink 4*d*. Therefore, the print head 4*c* of the print head unit 4 can be positioned in an alignment relative to the platen roller 5 in spite of the collision between the contact parts 11*a* and 12*a* and the heat sink 4*d*.

The motor 17 drives the feed roller 9 regardless of the direction in which the motor 17 is driven, and drives the winding reel 3 only when the motor 17 is driven in one (printing) direction. As the motor 17 is driven, a motor gear 17*a* mounted on the axle of the motor 17 rotates in the direction of arrow A1 in FIG. 4. Then, the feed roller gear 20 rotates in the direction of arrow B1 in FIG. 4 via the intermediate gears 22 and 23. The paper 30 is thereby conveyed in the paper conveying direction (direction of arrow C1 in FIG. 10) by the rotation of the feed roller 9 in the direction of arrow B1 as shown in FIGS. 4 and 10.

At this time, the swing gear 21 swings toward the gear 3*a* and meshes with the gear 3*a* of the winding reel 3 to rotate the gear 3*a* of the winding reel 3 in the direction of arrow D1 in FIG. 4. The ink ribbon 2*d* wound around the winding bobbin and the supply bobbin 2*c* is thereby taken up by the rotation of the winding bobbin (not shown), which is in engagement with the winding reel 3.

As the print head unit 4 is pivoted, the cap 7*c* mounted on the second side part 7*e* of the pivotable member 7*a* of the pressing mechanism 7 applies pressure to the top surface of the heat sink 4*d* of the print head unit 4 while the paper 30 and the ink ribbon 2*d* are being conveyed. Therefore, the print head 4*c* of the print head unit 4 is pressed against the platen roller 5 via the paper 30 and the ink ribbon 2*d*. In this manner, printing is performed.

During printing, as shown in FIG. 10, the print head unit 4 is pressed on by the cap 7*c* mounted on the second side part 7*e* of the pivotable member 7*a* of the pressing mechanism 7 with an amount of pressing force W1 (about 5 kgf in this embodiment), and therefore the print head unit 4 receives a frictional force of μW1, which is about 8.8 N in this embodiment, in the paper conveying direction (direction of arrow C1 in FIG. 10). The symbol "μ" is the dynamic coefficient of friction. Also, the feed roller 9 that is conveying the paper 30 receives a reaction force W2 in the opposite direction from the paper conveying direction as the feed roller 9 conveys the paper 30 during the printing operation.

As described above, the support hole 4*e* of the print head unit 4 has a greater inside diameter than the outside diameter of the support axis 4*a*. Therefore, the print head unit 4 can move horizontally relative to the support axis 4*a* within a specific distance while being supported by the support axes 4*a*. Therefore, even when the contact parts 11*a* and 12*a* of the feed roller bearings 11 and 12 do not come into contact with the heat sink 4*d* of the print head unit 4 when the print head unit 4 is brought down toward the platen roller 5, the arm units 4*b*, the print head 4*c*, and the heat sink 4*d* can be moved toward the contact parts 11*a* and 12*a* of the feed roller bearings 11 and 12 by the frictional force μW1. The contact parts 11*a* and 12*a* of the feed roller bearings 11 and 12 therefore come into contact with the heat sink 4*d* of the print head unit 4.

The contact part 11*a* of the feed roller bearing 11 and the heat sink 4*d* of the print head unit 4 thereby come into contact with each other so that the print head unit 4 is pressed against the platen roller 5. Therefore, the frictional force μW1 received by the print head unit 4 in the paper conveying direction (direction of arrow C1 in FIG. 10) is at least partially canceled out by the reaction force W2 that the feed roller 9 receives in the direction opposite the paper conveying direction when the feed roller 9 conveys paper 30 while being rotatably supported on the feed roller bearing 11.

Therefore, in the first embodiment, it is possible to restrict the shifting of the print head unit 4 in the paper conveying direction (direction of arrow C1 in FIG. 10) that occurs due to the frictional force μW1 received by the print head unit 4 during the printing operation. It is therefore possible to improve printing precision, since shifting of the position of the print head 4*c* of the print head unit 4 in relation to the platen roller 5 can be restricted during printing.

Also, since the reaction force W2 received by the feed roller 9 and the feed roller bearings 11 and 12 in the direction opposite the paper conveying direction (direction of arrow C1 in FIG. 10) is canceled out by the frictional force μW1 of the print head unit 4, it is possible to stabilize the position of the feed roller 9 and the feed roller bearings 11 and 12. As a result, the occurrence of non-uniformities in the feeding of the paper 30 can be suppressed, and the precision with which the paper 30 is fed can be improved.

Furthermore, since paper 30 is conveyed by the metal feed roller 9 and the metal press roller 10, the precision in feeding the paper 30 is superior in comparison with a case in which paper 30 is conveyed with a platen roller 5 that is made of rubber or another such material prone to elastic deformation.

Also, in the first embodiment, the contact parts 11*a* and 12*a* that come into contact with the heat sink 4*d* of the print head unit 4 are integrally provided to the feed roller bearings 11 and 12. Therefore, the reaction force W2 received by the feed roller 9 in the direction opposite the paper conveying direction (direction of arrow C1 in FIG. 10) can be transmitted to the print head unit 4 via the contact parts 11*a* and 12*a* of the feed roller bearings 11 and 12. It is thereby possible to easily cancel out the frictional force μW1 received by the print head unit 4 at least partially.

Furthermore, since the contact parts 11*a* and 12*a* are unitarily provided with the feed roller bearings 11 and 12, there is no need to separately provide the contact parts 11*a* and 12*a*. Therefore, it is possible to prevent an increase in the number of components, while enabling the structure present embodiment.

Also, in the first embodiment, the tapered parts (chamfered parts) 11*b* and 12*b* are provided in the top portions of the contact parts 11*a* and 12*a* of the feed roller bearings 11 and 12. Thus, even if the print head unit 4 contacts the tapered parts 11*b* and 12*b* of the contact parts 11*a* and 12*a* of the feed roller bearings 11 and 12, the tapered parts 11*b* and 12*b* can let go of the print head unit 4, and the print head unit 4 can be easily pivoted toward and pressed against the platen roller 5.

Also, in the first embodiment, the print head unit 4 is provided with the support axes 4*a* as the center of pivoting of the print head unit 4, as well as the support holes 4*e* which pivotably support the axles 4*a* while allowing the print head unit 4 to move horizontally within a specific amount. Therefore, the arm units 4*b*, the print head 4*c*, and the heat sink 4*d* can be moved horizontally by the frictional force μW1, which is received by the print head unit 4, in the paper conveying direction (direction of arrow C1 in FIG. 10) during printing. Thus, even when the print head unit 4 is pivoted toward the platen roller 5 without coming into contact with the feed roller bearings 11 and 12, the heat sink 4*d* of the print head unit 4 and the contact parts 11*a* and 12*a* of the feed roller bearings 11 and 12 can be easily brought into contact.

Second Embodiment

Figure 12:
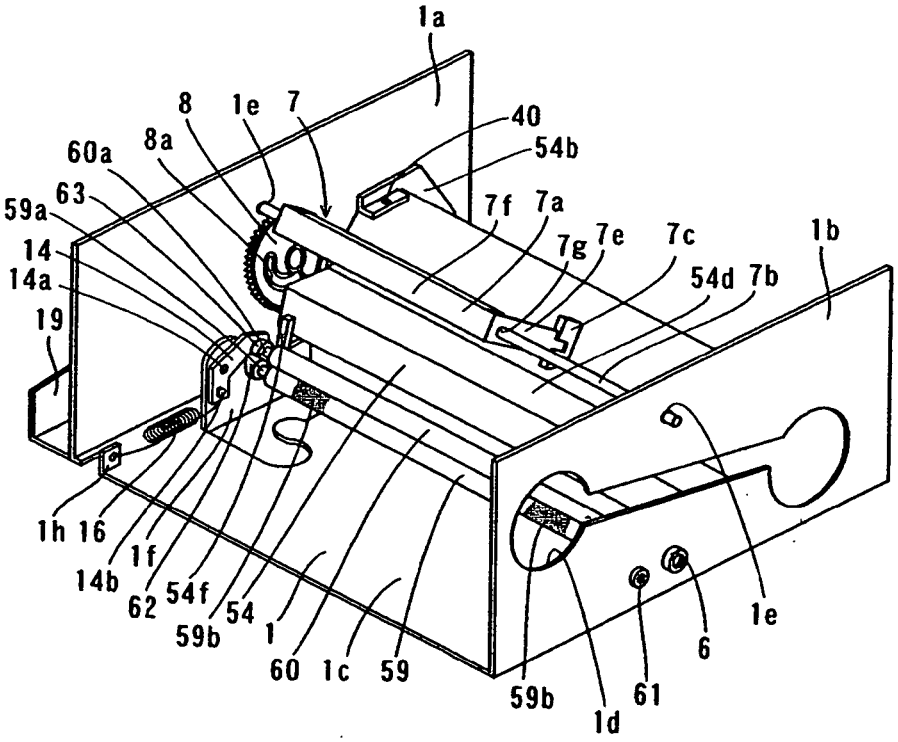
FIG. 12 is a perspective of showing the entire structure of a heat transfer printer according to the second embodiment of the present invention.
Figure 13:
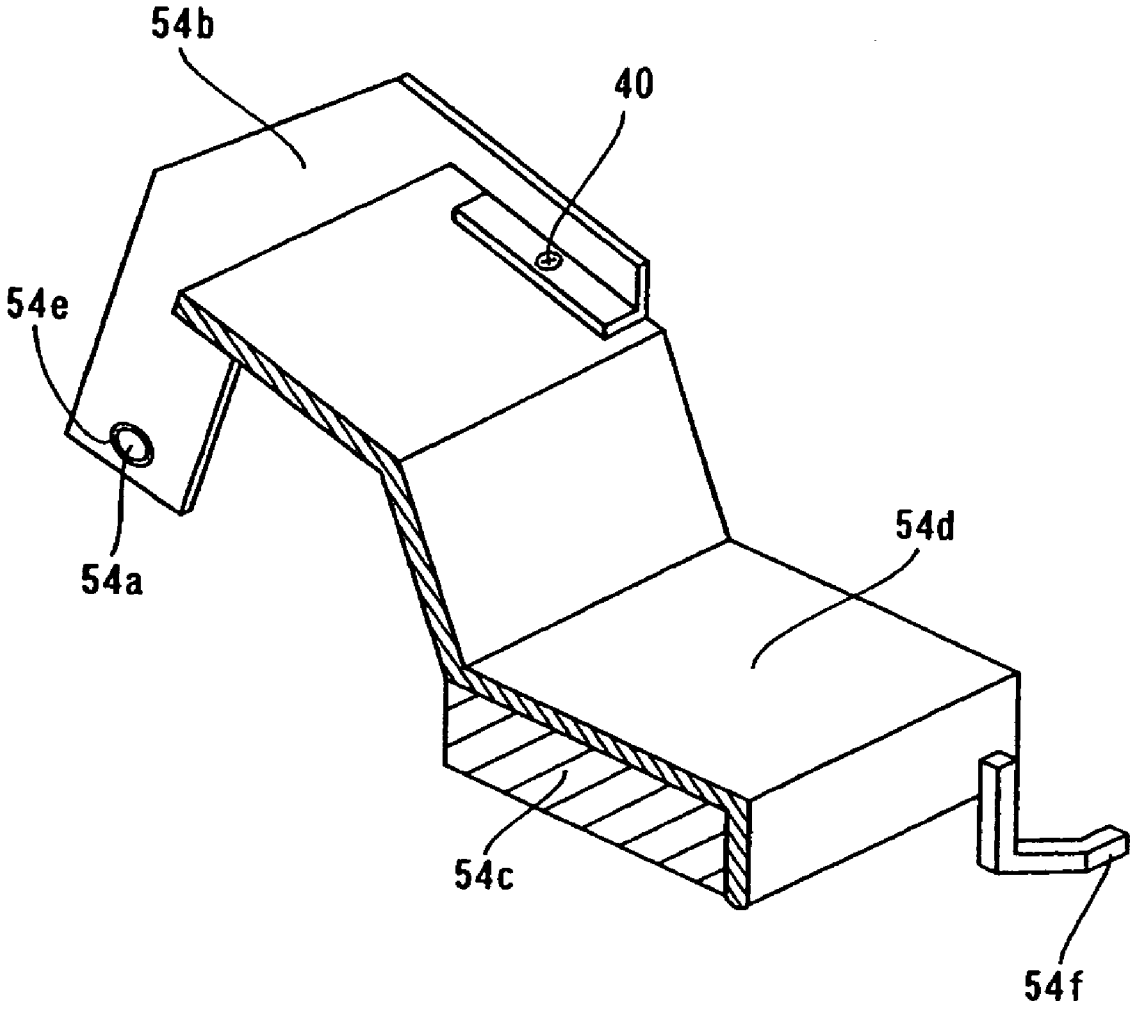
FIG. 13 is a partial cross-sectional view showing the print head unit of the heat transfer printer according to the second embodiment shown in FIG. 12.
Figure 14:
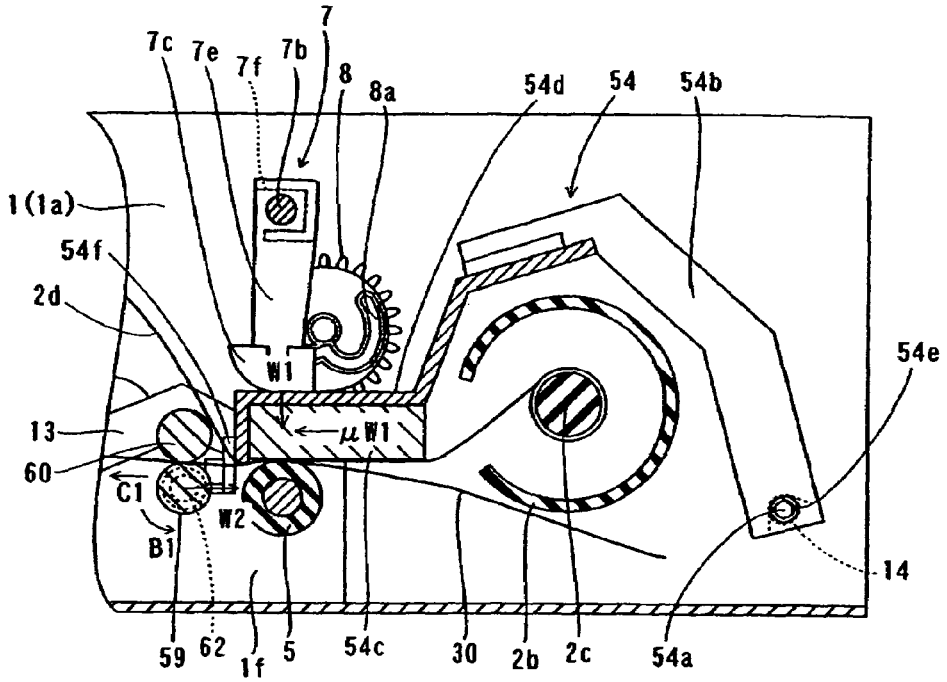
FIG. 14 is a schematic side view of the pressing mechanism in a state in which the print head unit is pressed against the platen roller in the heat transfer printer according to the second embodiment shown in FIG. 12.
Figure 15:
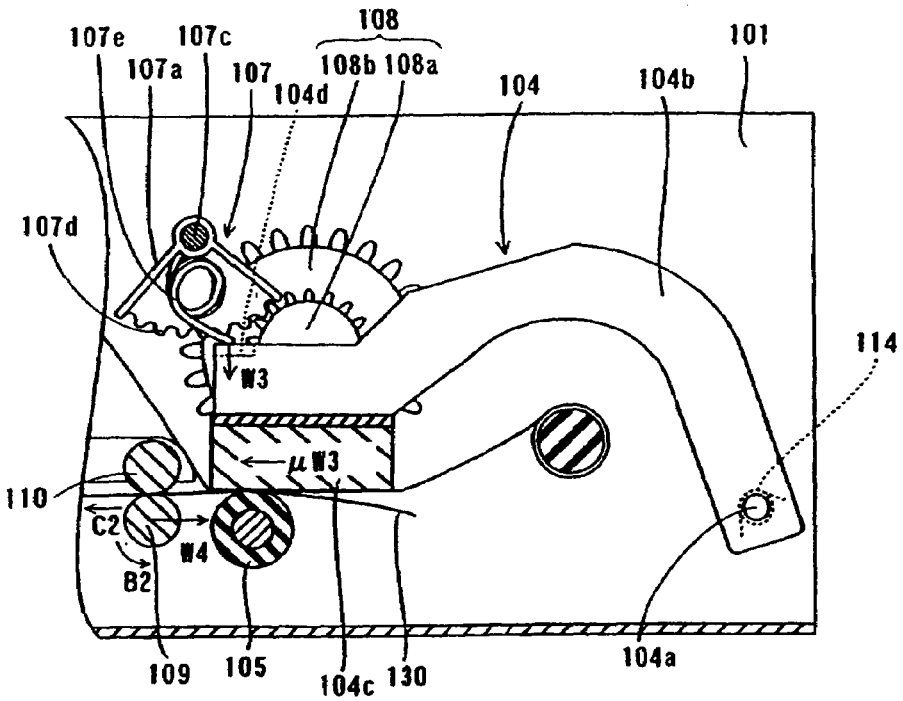
FIG. 15 is a schematic side view showing the pressing mechanism of the conventional heat transfer printer in a state in which the print head unit is pressed against the platen roller.

The heat transfer printer in accordance with the second embodiment is described with reference to FIGS. 12 through 14. In view of the similarity between the first and second embodiments, descriptions of the structures of the second embodiment that are similar to those of the first embodiment will be omitted herein. Furthermore, the structures of the second embodiment that are similar to those of the first embodiment are given the same reference numbers. FIG. 12 is a perspective view of the entire structure of a heat transfer printer according to the second embodiment of the present invention. FIG. 13 is a partial perspective view showing the print head unit of the heat transfer printer according to the second embodiment shown in FIG. 12. FIG. 14 is a schematic side view showing the pressing mechanism in a state in which pressure is applied to the print head unit in the heat transfer printer according to the second embodiment shown in FIG. 12.

Unlike the first embodiment, protrusions that come into contact with the feed roller bearings are integrally provided to the heat sink of print head unit in the second embodiment. The structures other than those of the print head unit, the feed roller, the press roller, the feed roller bearings, and the press roller bearings are similar to those in the first embodiment. Therefore, further descriptions of structures that are similar to those of the first embodiment are omitted herein.

In the heat transfer printer according to the second embodiment, the bearing support units 59*a* of the feed roller 59 have a smaller diameter than the outermost periphery of the feed roller 59, as shown in FIG. 12. The bearing support units 59*a* of the feed roller 59 are also rotatably supported by the feed roller bearings 61 and 62 (see FIGS. 12 and 14). Protrusions of a specific height are formed by rolling on the surfaces of the paper conveying portions 59*b* of the feed roller 59. The bearing support units 60*a* of the press roller 60 have a smaller diameter than the outermost periphery of the press roller 60. Also, the bearing support units 60*a* of the press roller 60 are rotatably supported by the press roller bearings 63.

As shown in FIGS. 13 and 14, the print head unit 54 is supported by the chassis 1 so as to be pivotable around support axles 54*a*, and includes arm units 54*b* which are pivotably supported by the chassis 1, a print head 54*c*, a heat sink 54*d* for radiating the heat of the print head unit 54, and support holes 54*e* formed on the arm units 54*b*. Protrusions 54*f* (another example of the contact portions) that are unitarily provided to the heat sink 54*d* of the print head unit 54. The protrusions 54*f* are L-shaped protrusions that extend toward the feed roller bearings 61 and 62, and come in contact with the feed roller bearings 61 and 62 when the print head unit 54 is pressed against the platen roller 5.

In the second embodiment, as described above, protrusions 54*f* that come in contact with the feed roller bearings 61 and 62 are unitarily provided to the heat sink 54*d* of the print head unit 54. Therefore, the frictional force μW1 received by the print head unit 54 in the paper conveying direction (direction of arrow C1 in FIG. 14) can be transmitted to the feed roller 59 via the protrusions 54*f*, which are provided to the heat sink 54*d* of the print head unit 54, and the feed roller bearings 61 and 62. Accordingly, the frictional force μW1 received by the print head unit 54 can be easily canceled out by the reaction force W2 received by the feed roller 59 at least partially.

Also, since the protrusions 54*f* are integrally provided with the heat sink 54*d*, there is no need to separately provide protrusions that come into contact with the feed roller bearings 61 and 62. Therefore, the number of components can be prevented from increasing while enabling the structure of the present embodiment.

The embodiments currently disclosed should be considered as examples in all respects and not as being restrictive. The scope of the present invention is expressed by the patent claims and not by the above descriptions of the embodiments, and further includes meanings equivalent to the range of the patent claims and all variations within this range.

For example, in the first and second embodiments, a heat transfer printer is given as an example of an image forming apparatus. However, the present invention is not limited thereto. The present invention can be applied to image forming apparatuses other than heat transfer printers, as long as such image forming apparatuses include a print head unit and feed roller bearings.

Also, in the first embodiment, the contact parts of the feed roller bearings are unitarily formed the feed roller bearings. However, the present invention is not limited to such construction, and the contact parts of the feed roller bearings may be provided separately.

Also, in the second embodiment, the protrusions are provided to the heat sink integrally. However, the present invention is not limited to such construction, and protrusions may be provided separately be mounted to the heat sink.

As used herein, the following directional terms "forward, rearward, above, downward, vertical, horizontal, below and transverse" as well as any other similar directional terms refer to those directions of a device equipped with the present invention. Accordingly, these terms, as utilized to describe the present invention should be interpreted relative to a device equipped with the present invention.

The term "configured" as used herein to describe a component, section or part of a device includes hardware and/or software that is constructed and/or programmed to carry out the desired function.

Moreover, terms that are expressed as "means-plus function" in the claims should include any structure that can be utilized to carry out the function of that part of the present invention.

The terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents. Thus, the scope of the invention is not limited to the disclosed embodiments.

What is claimed is:

1. An image forming apparatus comprising:

a chassis;

a print head unit pivotably supported by the chassis;

a platen roller rotatably supported by the chassis to perform printing with the print head unit;

a metal feed roller rotatably supported by the chassis to convey paper;

a metal press roller rotatably mounted to the chassis so as to be pressed against the feed roller to convey paper;

feed roller bearings mounted to the chassis for rotatably supporting the feed roller; and a contact portion formed integrally with at least one of the print head unit and the feed roller bearings, the contact portion bulging toward the other of the print head unit and the feed roller bearings, the print head unit and the feed roller bearings being arranged such that the contact portion is pressed into contact with the other of the print head unit and the feed roller bearings when the print head unit is pressed against the platen roller during printing.

2. The image forming apparatus according to claim 1, wherein each of the feed roller bearings is unitarily provided with the contact portion.

3. The image forming apparatus according to claim 2, wherein a tapered portion is further formed on the contact portion.

4. The image forming apparatus according to claim 1, wherein the print head unit has a print head, arm units pivotably supported by the chassis, a heat sink formed to cover the print head for radiating the heat of the print head, and the heat sink of the print head unit is unitarily provided with the contact portion.

5. The image forming apparatus according to claim 1, wherein the print head unit is supported by the chassis with support axes, and the support axes support the print head unit such that the print head unit is horizontally movable when the print head unit is pressed against the platen roller.

6. The image forming apparatus according to claim 5, wherein the support axes are inserted in support holes formed on the print head unit, and an inside diameter of the support holes is larger than an outside diameter of the support axes.

7. The image forming apparatus according to claim 2, wherein the contact portion is bulging portions that are formed unitarily with each feed roller bearing so as to bulge toward the print head unit.

8. The image forming apparatus according to claim 4, wherein the contact portion is a plurality of L-shaped protrusions that extend toward the feed roller bearings.

9. An image forming apparatus comprising:

a chassis;

a print head unit pivotably supported by the chassis;

a platen roller rotatably supported by the chassis to perform printing with the print head unit;

a metal feed roller rotatably supported by the chassis to convey paper;

a metal press roller rotatably mounted to the chassis so as to be pressed against the feed roller to convey paper;

feed roller bearings mounted to the chassis for rotatably supporting the feed roller; and a contact portion uniformly formed with each of the feed roller bearings, the contact portion bulging toward the print head unit, such that the contact portion is pressed into contact with the print head unit when the print head unit is pressed against the platen roller during printing, wherein a tapered portion is further formed on the contact portion, the print head unit is supported by the chassis with support axes, the support axes support the print head unit such that the print head unit is horizontally movable when the print head unit is pressed against the platen roller, the support axes are inserted in support holes formed on the print head unit, an inside diameter of the support holes is larger than an outside diameter of the support axes, and the contact portion is bulging portions that are formed unitarily with each feed roller bearing so as to bulge toward the print head unit.

* * * * *